United States Patent [19]

Ueno et al.

[11] Patent Number: 4,571,977

[45] Date of Patent: Feb. 25, 1986

[54] METHOD OF FORGING FLANGED SHAFT

[75] Inventors: Keii Ueno, Tokyo; Masanobu Ueda, Yokohama; Minoru Tanikawa, Shimizu; Masami Suzuki, Shizuoka, all of Japan

[73] Assignee: Hitachi, Ltd., Tokyo, Japan

[21] Appl. No.: 420,892

[22] Filed: Sep. 21, 1982

[30] Foreign Application Priority Data

| | | | |
|---|---|---|---|
| Sep. 22, 1981 | [JP] | Japan | 56-148685 |
| Dec. 8, 1981 | [JP] | Japan | 56-196315 |
| Jan. 20, 1982 | [JP] | Japan | 57-6045 |

[51] Int. Cl.[4] ..... B21D 37/16; B21D 22/00

[52] U.S. Cl. ..... 72/342; 72/356; 72/352; 72/359

[58] Field of Search ..... 29/6; 72/316, 318, 342, 72/356, 357, 359

[56] References Cited

U.S. PATENT DOCUMENTS

| | | | |
|---|---|---|---|
| 537,577 | 4/1895 | Mason | 72/359 |
| 2,169,892 | 8/1939 | Criley | 72/364 |
| 3,680,381 | 8/1972 | Porral | 72/357 |
| 4,317,355 | 3/1982 | Hatsumo et al. | 72/342 |
| 4,425,779 | 1/1984 | Diemer et al. | 72/356 |

*Primary Examiner*—Lowell A. Larson
*Assistant Examiner*—Jorji M. Griffin
*Attorney, Agent, or Firm*—Antonelli, Terry & Wands

[57] ABSTRACT

A forging method for producing a flanged shaft such as, for example, a crankshaft, provided at its intermediate portion with a flange with the flanged shaft being formed from a blank having a diameter which is smaller than the diameter of the shaft end portions but large enough to prevent buckling of the blank when the latter is compressed in the axial direction. The blank is placed within a closed die apparatus and is axially compressed by a punch so that it is possible to produce the flanged shaft at a high dimensional precision and at a high yield, while reducing the time and labor for finishing work conducted after the forging, without requiring any large-size press.

6 Claims, 21 Drawing Figures

METHOD OF FORGING FLANGED SHAFT

BACKGROUND OF THE INVENTION

The present invention relates to a method of forging a shaft provided at its intermediate portion with at least one flange, hereinafter referred to as a "flanged shaft", such as, for example, a crankshaft. More particularly, the invention is concerned with a method of forging a flanged shaft improved to achieve higher yield from a blank, as well as higher dimensional precision.

Flanged shafts of this kind have been produced by various methods such as casting, cutting, forging and so forth.

The production of the flanged shaft by casting, however, requires feeder heads in order to compensate the shrinkage, resulting in a yield from material as low as about 70%. It is also to be pointed out that, because of inferior dimensional precision, a cutting margin of 2 to 3 mm has to be left in the cast blank and a number of steps are required to finish the cast blank into final product.

On the other hand, the production of flanged shaft by cutting requires a large number of steps and the yield from blank becomes is impractically low, because the flanged shaft is cut out from a blank which has a diameter equal to the maximum diameter, i.e. the flange diameter, of the flanged shaft.

The production of flanged shaft by forging is made by placing a blank between an upper die and a lower die which in combination form, when brought together, a cavity having a configuration substantially conforming with the configuration of the final product and then pressing the upper die in a direction perpendicular to the axis of the shaft while placing the lower die on the bed of a press, to thereby produce the flanged shaft. This method suffers, as in the case of production by cutting, an impractically low yield from blank because the blank material used has a diameter equal to the flange diameter. In addition, many flashes are formed to increase the area of contact between the blank and the dies to require greater pressing force which can be produced only by a large-size press. Furthermore, since the dies are incapable of being intimately closed, this method can provide only an inferior dimensional precision to require a large tolerances, as well as greater number of steps for finishing the forged blank into the final product.

In ordinary process for producing a crankshaft by forging, a blank placed between an upper die and a lower die is forged by the action of a press head which drives the upper die in the direction perpendicular to the axis of the shaft while the lower die is placed stationarily on the bed of the press. According to this method, since the cross-sectional area of the crankshaft perpendicular to the axis varies along the length, it is necessary to use a blank having an outside diameter approximating that of the crank pin portion (maximum diameter portion of the crankshaft) in order that the portion of the die cavity corresponding to the crank pin is filled by the material. Therefore, the material exceeds the required amount in the die cavity portion corresponding to the rod portion of the crankshaft to cause generation of many flashes in such portion of the forged blank. The generation of many flashes increases the area of contact between the blank and the dies to require a large forging force which in turn necessitates a large-size press. In addition, since the dies used in this process are not of a closed type, it is impossible to forge the blank with sufficiently high dimensional precision. This in turn requires a considerable dimensional tolerance and also greater number of steps for finishing the forged blank into final product.

SUMMARY OF THE INVENTION

Accordingly, it is an object of the invention to provide a forging method for producing a flanged shaft by forging, which can ensure a high yield from blank, as well as high dimensional precision while reducing the number of steps of finishing process, without using large-size press, to thereby obviate the above-described problems of the prior art.

It is another object of the invention to provide a forging method for producing a crankshaft by forging, which can ensure a high yield from material, as well as high dimensional precision to reduce the number of steps of finishing process, without using large-size press, to thereby overcome the above-described problems of the prior art in the production of crankshaft.

It is still another object of the invention to provide a forging method of producing a crankshaft by forging, which is improved to eliminate troubles such as failure of punch, even when applied to the preforging of a cranskshaft having a rod portion of large length-to-diameter ratio of rod portions as in the case of the crankshaft of a compressor.

To these ends, according to one aspect of the invention, there is provided a forging method for producing a flanged shaft provided at its intermediate portion with at least one flange, comprising the steps of: preparing a closed die means defining therein a die cavity of a configuration substantially conforming with that of the flange and shaft portions of the flanged shaft; inserting a blank into the die means, the blank having a diameter smaller than the diameter of the shaft portion but large enough to avoid buckling when compressed in the axial direction; and compressing the blank in the axial direction to thereby produce the flanged shaft.

According to another aspect of the method of the invention, the preformed blank is inserted into another die means consisting of an upper die and a lower die which cooperate, when brought together, with each other in defining therebetween a die cavity of a configuration substantially conforming with the final configuration of the crankshaft, and compressing the preforged blank in the direction perpendicular to the axis to thereby produce the crankshaft.

According to still another aspect of the method of the invention, for producing a crankshaft, the blank is preheated only at region thereof which will become the pin portion of the crankshaft, as well as portions around the region, with the preheated blank being into the closed die means; and compressed in the axial direction to preforge the pin portion. The preforged blank is inserted into an openable die means consisting of an upper die and a lower die which cooperate, when brought together, with each other in defining therebetween a die cavity of a configuration substantially conforming with the final configuration of the crankshaft. The preforged article is compressed in the direction perpendicular to the axis to thereby produce the crankshaft.

DETAILED DESCRIPTION

Figure 1:
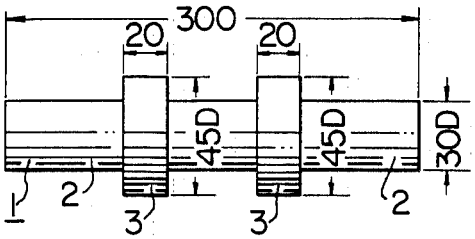
FIG. 1 is a side elevational view of an example of a flanged shaft.

Referring now to the drawings wherein like reference numerals are used throughout the various views to designate like parts and, more particularly, to FIG. 1, according to this figure, a flanged shaft generally designated by the reference numeral 1 has two flanges 3 formed at intermediate portions thereof and shaft end portions 2 of a substantially equal length.

Figure 2:
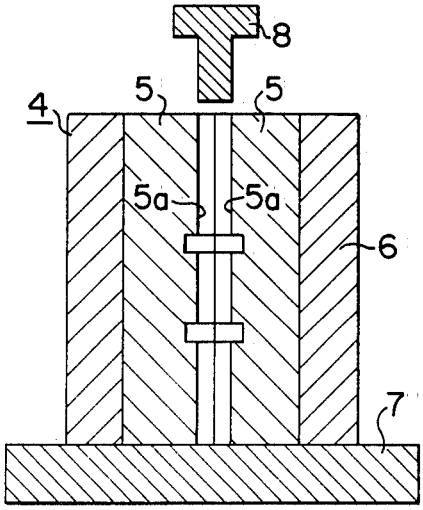
FIG. 2 is a sectional view of a closed die apparatus used in a forging method in accordance with an embodiment of the invention for producing a flanged shaft.

Referring to FIG. 2, the sectional closed die apparatus generally designated by a reference numeral 4 has a sectional die assembly 5 including two die parts which are adapted to define, when brought together, a die cavity 5*a* of a configuration conforming with that of the flanged shaft 1, a shrink ring 6 adapted to receive and fix the two die parts of the die assembly 5 during the production, a base 7 for mounting thereon the shrink ring 6 accomodating the die assembly 5, and an upper punch 8 attached to a pressing head (not shown) of a press and adapted to be slidingly driven into the die cavity 5*a* formed by two die parts of the die assembly 5.

A blank is prepared to have a diameter smaller than the diameter of the shaft portion 2 of the flanged shaft but large enough to prevent buckling of the blank when the latter is compressed in the axial direction. In the illustrated embodiment, the shaft portion 2 of the flanged shaft has a diameter of 30 mm, and the blank has a diameter of 29.5 mm and a length of 362 mm. This blank is inserted into the die cavity 5*a* of the die apparatus 4 and then the pressing head is lowered to drive the upper punch 8 downwardly to thereby axially compress the blank. Consequently, the blank is plastically deformed so that the blank plastically flows to fill the die cavity 5*a* of the die assembly 5 to forge a completed article to result in flanged shaft 1 as shown, for example, in FIG. 1. Then, the die assembly is withdrawn from the shrink ring 6 and the die parts are separated from each other to permit the flanged shaft 1 to be easily removed from the die assembly.

According to this forging method, it is possible to attain a high yield from material (almost 100%), as well as a high dimensional precision (cutting margin less than 0.5 mm), because the flanged shaft 1 is forged by means of the closed die apparatus 4. Furthermore, the number of cutting steps which are to be taken after the forging by the die apparatus can be reduced remarkably due to the high dimensional precision.

In the conventional forging method explained before, many flashes are formed in, for example, shaft portions, because the blank used has a large diameter. These flashes are shown in the subsequent trimming step, so that the flow-line during plastic deformation is cut undesirably. In contrast, in the described embodiment of the invention, no flow-line is cut because almost no flash is formed in the shaft portion, so that the flanged shaft can be produced to have a superior mechanical strength.

Figure 3:
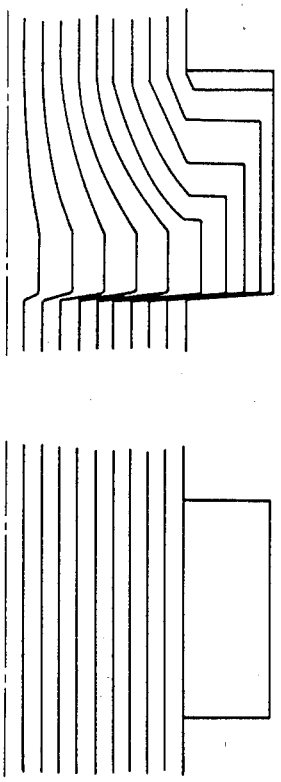
FIG. 3 illustrates the flow-line (metal flow) around a flange portion in a flanged shaft which is being forged by means of the closed die apparatus shown in FIG. 2, as obtained through a simulating calculation.
Figure 4:
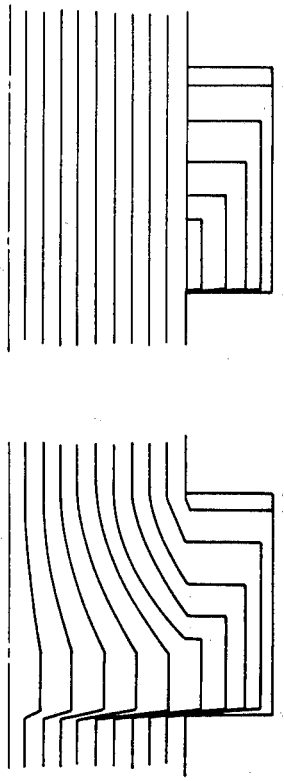
FIG. 4 illustrates the flow-line around a flange portion in the flanged shaft after forging by means of the die apparatus shown in FIG. 2, as obtained through a simulating calculation.
Figure 5:
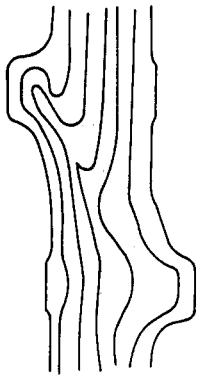
FIG. 5 illustrates the flow-line in an actual flanged shaft forged by means of the die apparatus shown in FIG. 2.

FIG. 3 shows the flow-line around the flange 3 of the flanged shaft 1 in the midway of forging of the flanged shaft 1, while FIG. 4 shows the flow-line after the completion of forging, and FIG. 5 shows the flow-line in a completed actual flanged shaft 1 formed by a closed die apparatus similar to that shown in FIG. 2.

In the middle of the forging process, as shown in FIG. 3, only the die cavity portion corresponding to the upper flange is filled by the material while the die cavity portion corresponding to the lower flange is not filled at all by the material. After the completion of forging, however, the die cavity portion corresponding to the lower flange is completely filled with the blank, but a disturbance of the flow-line is observed in the base portion of the upper flange as will be seen from FIG. 4. Namely, in the method of the present invention, the metal flow of the blank fills first the die cavity portion corresponding to the upper flange and then the die cavity portion corresponding to the lower flange. During the filling of the die cavity portion corresponding to the lower flange, the blank confined in the die cavity portion corresponding to the upper flange is restrained from moving, so that an internal shearing of blank takes place in the base portion of the upper flange to cause a disturbance of the flow-line. As shown in FIG. 5, the pattern of the flow-line of blank in this flanged shaft well corresponds to that obtained through the simulating calculation particularly in that there is a disturbance of flow-line around the base portion of the upper flange, although the central axes of the flanges are offset from the central axis of the shaft portion and the edges of the base portions of the flanges are rounded unlike the flow line pattern obtained through the simulating calculation.

The magnitude of such disturbance in the flow-line is largely affected by the size and shape of the upper flange. Namely, the disturbance in the flow-line is negligibly small when the upper flange is small but a considerably large disturbance is caused when the upper flange has a large size.

Figure 6:
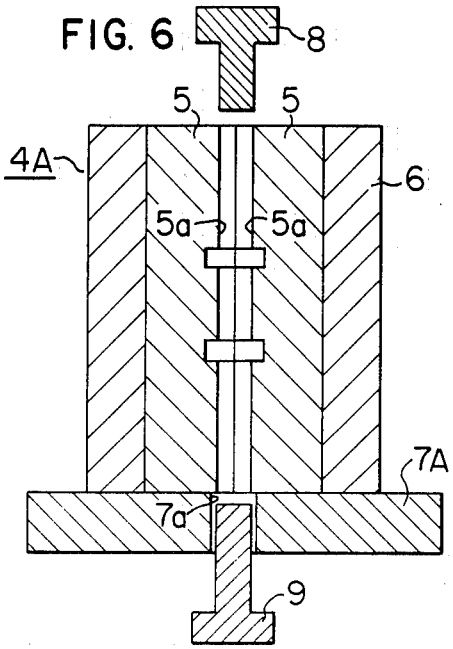
FIG. 6 is a sectional view of a closed die apparatus for use in a forging method in accordance with a second embodiment of the invention for producing a flanged shaft.

Referring to FIG. 6, a closed die apparatus 4A has a lower punch 9 which opposes to the upper punch 8 and is adapted to be driven slidingly into the lower part of the die cavity 5*a* from the lower side of the latter. The lower punch 9 is connected to a compressing source (not shown) such as a hydraulic cylinder disposed at the lower side of the bed of the press. A guide hole 7*a* formed in the base plate 7A is adapted to guide the lower punch 9.

Figure 7:
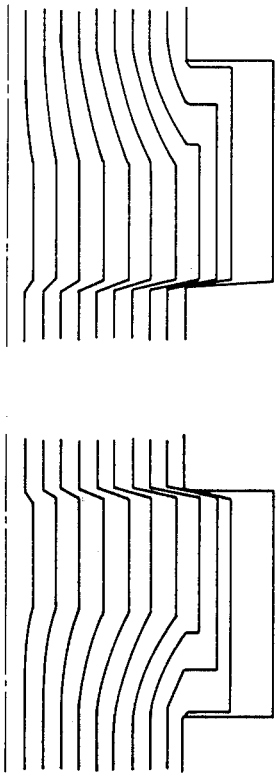
FIG. 7 illustrates the flow-line around the flange portion of a flanged shaft which is being forged by pressing in the closed die apparatus shown in FIG. 6 by means of an upper punch and a lower punch, as obtained through a simulating calculation.

In operation, the blank similar to that used in the first embodiment is inserted into the die cavity 5*a* of the closed die apparatus 4A from the upper side of the latter. The blank is then compressed axially from the upper and lower sides thereof by the upper and lower punches 8 and 9. Consequently, the upper portion of the blank is plastically deformed by the force exerted by the upper punch 8 to fill the die cavity portion corresponding to the upper flange, while the lower portion of the blank is plastically deformed by the force exerted by the lower punch to fill the die cavity portion corresponding to the lower flange. From FIGS. 7 and 8, it will be understood that there is no substantial disturbance of the flow-line in the base portion of the upper flange, and the blank uniformly fills the die cavity portions corresponding to the upper and lower flanges. As shown in FIG. 9, the disturbance of the flow-line is materially eliminated the actual flanged shaft. From this fact, it is understood that the use of the closed die apparatus 4A shown in FIG. 6, in combination with the upper and lower punches 8, 9 for simultaneously compressing the blank in the axial direction, eliminates the disturbance of the flow-line of blank in the region around the base portion of the upper flange and, hence, achieves a higher reliability of the flanged shaft 1 as compared with the flanged shaft forged by the closed die apparatus of the type shown in FIG. 2.

Figure 10:
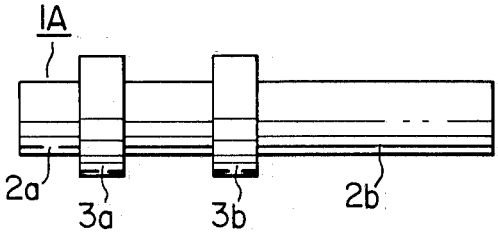
FIG. 10 is a side elevational view of another example of the flanged shaft having end portions of different lengths.

The flanged shaft generally designated by the reference numeral 1*a* shown in FIG. 10 has two flanges 3*a*, 3*b* produced at intermediate portions thereof and both shaft end portions 2*a*, 2*b* which have different lengths. This flanged shaft 1*a* is produced by forging conducted in accordance with a third embodiment of the invention by means of a closed die apparatus 4B shown in FIG. 11.

Figure 11:
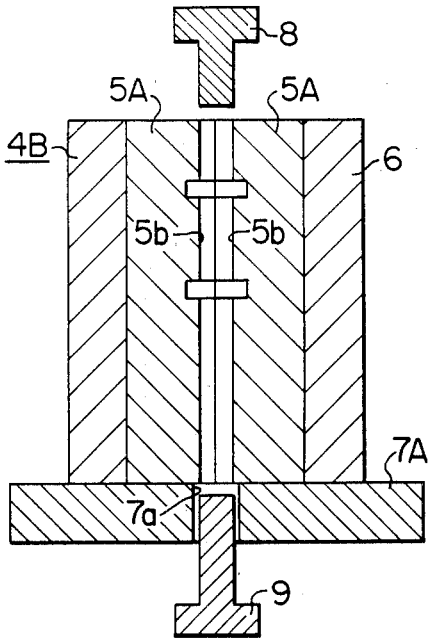
FIGS. 11 to 13*b* are sectional views of closed die apparatus for use in the forging method in accordance with a third to fifth embodiments of the invention for producing a flanged shaft.

In the illustrated embodiment of FIG. 11, the upper straight portion of the die cavity 5*b* of a closed die apparatus 4A, having a sectional die assembly 5A, corresponding to the first shaft end portion 2*a* has a length smaller than that of the lower straight portion of the die cavity for forging the second shaft end portion 2*b*.

For forging the flanged shaft 1A, a blank is prepared to have a diameter smaller than the diameter of the first and second shaft end portions 2*a*, 2*b* but large enough to prevent buckling of the blank when the latter is axially compressed. The blank is inserted into the die cavity 5*b* from the upper side, and is compressed from the upper side and lower side thereof with a certain time differential. More specifically, the compression is applied first from the upper side only by the upper punch 8 while the lower punch is fixed by, for example, blocking the hydraulic circuit. Consequently, the blank flows plastically only into the portion of the die cavity 5*b* corresponding to the first flange 3*a*, as in the case of the embodiment of FIG. 3. The application of compression by the upper punch 8 stops when the above-mentioned portion of the die cavity 5*b* has been completely filled with the blank, i.e. after the forging of the first flange 3*a*. Then, the upper punch 8 is fixed. It will be seen that, in this state, almost no flow of blank has taken place into the die cavity portion corresponding to the second flange 3*b*. Then, the lower punch 9 is released and driven to apply a compression to the blank from the lower side thereof, thereby to cause a plastic flow of the blank into the die cavity portion corresponding to the second flange 3*b* to fill this portion of the die cavity, i.e. to produce the second flange 3*b*.

Figure 8:
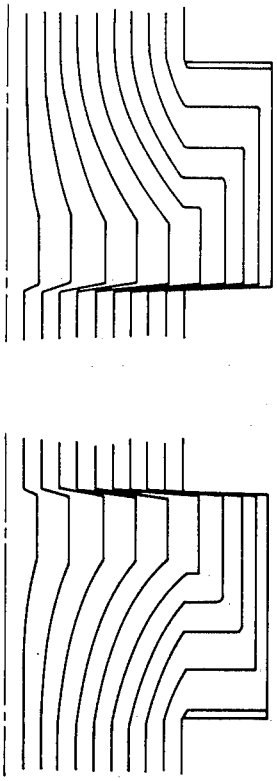
FIG. 8 is an illustration of the flow-line around the flange portion in a flanged shaft after forging by pressing in the closed die apparatus shown in FIG. 6 by means of an upper die and a lower die, as obtained through simulation calculation.
Figure 9:
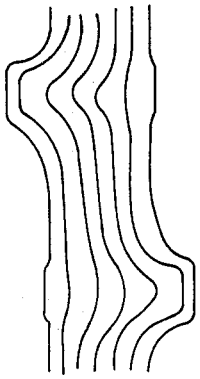
FIG. 9 illustrates the flow-line around the flange portion in an actual flanged shaft produced by pressing within the closed die apparatus shown in FIG. 6 by means of an upper punch and a lower punch.

It will be seen that, the forging method of this embodiment is effective in forging a flanged shaft 1A suffering no substantial disturbance of the flow-line as in the case of the embodiment shown in FIG. 8 and having two shaft end portions 2*a*, 2*b* of different lengths.

In the forging method of the embodiment shown in FIGS. 10 and 11, the period of operation of the upper punch 8 and the period of operation of the lower punch 9 are staggered for the following reason. Assume here that ,he upper punch 8 and the lower punch 9 are driven simultaneously to axially compress the blank in the closed die apparatus shown in FIG. 11, since a friction is generated between each shaft end portion 2*a*, 2*b* and corresponding inner peripheral surface of the die assembly 5A, the force exerted by the upper punch 8 and the lower punch 9 is not directly transmitted to the flange portions 3*a*, 3*b*. Namely, only a reduced force is applied to the flange portions of the blank. More specifically, since the second shaft end portion 2*b* has a length greater than the first shaft end portion 2*a*, the force applied to the portion constituting the second flange 3*b* is smaller than the force applied to the portion constituting the first flange 3*a*. The reduction in force exerted by the lower punch 9 becomes larger as the friction coefficient becomes greater and as the length of the second flange 2*b* becomes larger. Namely, under such a condition, the force effectively applied to the portion of the blank constituting the second flange 3*b* is considerably small so that it becomes almost impossible to displace the blank upwardly by means of the lower punch 9. In this case, the pattern of flow-line in the shaft is similar to that shown in FIG. 4, and no substantial effect is produced by the lower punch 9. This problem, however, is avoided and the flanged shaft 1A can be forged to have a distinguished reliability in mechanical strength, by staggering the periods of operation of the upper punch 8 and lower punch 9.

As will be understood from the foregoing description, the closed die apparatus 4B shown in FIG. 11, combined with the upper punch 8 and the lower punch 9 opposing to the upper punch 8, is effective in the production of the flanged shaft 1A having shaft end portions 2*a*, 2*b* of different lengths, when the periods of operation of the upper and lower punches 8, 9 are staggered. The flanged shaft 1A, having shaft end portions 2*a*, 2*b* of different lengths, can be produced by other methods of the invention.

Figure 12:
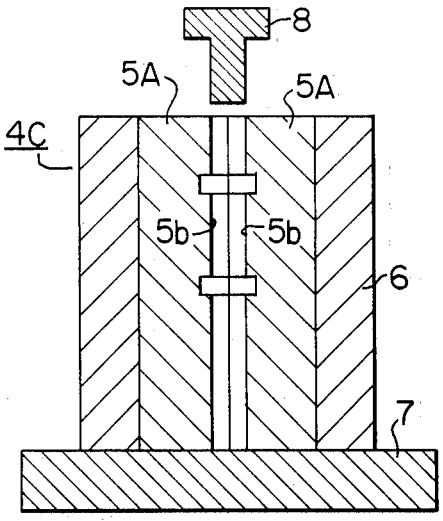

As shown in FIG. 12, closed die apparatus 4C of this embodiment lacks the lower punch so that a compression is applied to the blank only from the upper side of the latter. A blank is prepared to have an outside diameter smaller than the shaft end portions 2*a*, 2*b* (see FIG. 10) of the flanged shaft to be obtained but large enough to prevent buckling of the blank when the latter is compressed in the axial direction. The blank is then inserted into the die cavity 5*b* of the closed die apparatus 4C. Then, the upper punch 8 is driven to compress the blank to cause a plastic flow of the blank to thereby fill the portion of the die cavity 5*b* corresponding to the first flange thereby to produce the first flange 3*a*. The application of compression is then stopped and the die assembly 5A, together with the shrink ring 6 fitting around the die assembly 5A and the half-finished blank (not shown) held therein, is turned upside down and the application of compression is started again by the upper punch 8 so that the portion of the die cavity 5*b* corresponding to the second flange 3*b*, now taking the position above the first flange, is filled with the blank thus producing the second flange 3*b*. By so doing, it is possible to produce the flanged shaft 1A without substantial disturbance of the flow-line of blank.

Figure 13A:
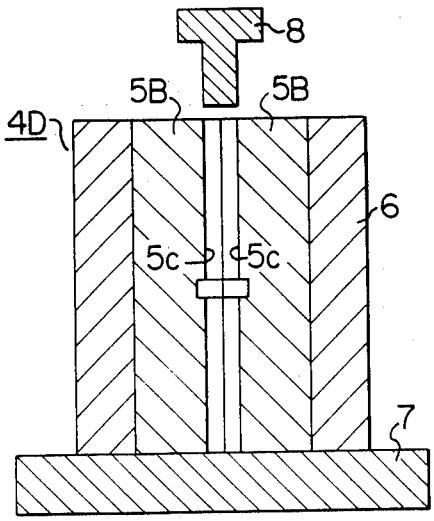
Figure 13B:
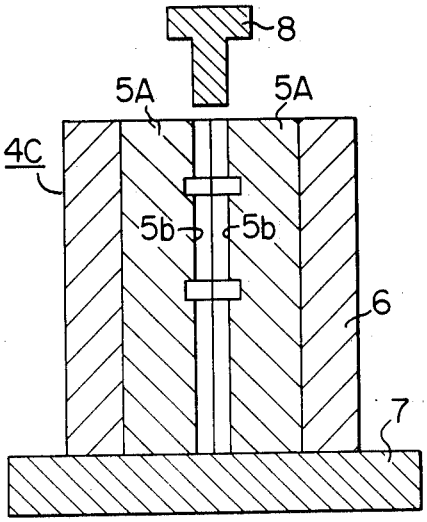

In FIGS. 13*a* and 13*b*, closed die apparatus 4D also lack the lower punch so that the compression is applied to the blank only from the upper side thereof. More specifically, as shown in FIG. 13*a*, a first closed die apparatus 4D includes a die cavity 5*c* of a configuration corresponding to the shaft end portions and the second flange 3*b* and, hence, adapted to forge the second flange 3*b* and the shaft end portion. In FIG. 13*b*, a second closed die apparatus 4C having a die cavity 5*b* of a configuration conforming with the final flanged shaft 1A and thus intended for forging of the first flange 3*a*.

In operation, a blank received by the closed die apparatus 4D is compressed by means of an upper punch 8 so that the blank plastically flows to fill up the die cavity 5*c* to form the second flange 3*b*. Then, the die assembly 5B is withdrawn produce the shrink ring 6 and the half-finished blank having the second flange 3*b* is taken out of the die assembly 5B after separating the die members from each other. This half-finished blank is then placed between the die parts of the second die assembly 5A and these die parts are brought together and fixed within the shrink ring 6 of the closed die apparatus 4C as shown in FIG. 13*b*. In this state, the second flange 3*b* is received by the portion of the die cavity 5*b* corresponding to the second flange 3*b*. Then, compression is applied to the blank from the upper side by the punch 8 so that the material of the blank plastically flows into the die cavity portion corresponding to the first flange 3*a* to produce the first flange 3*a* thus completing the flanged shaft 1A having no disturbance of the flow-line.

The method employing the closed die apparatus 4B in FIG. 11 having the lower punch 9 opposing to the upper punch 8 requires a special press provided with a compressing source beneath the bed. In contrast, the methods of FIGS. 12 and 13 do not require such a special press but rather the flanged shaft 1A can advantageously be produced with an ordinary press.

The method FIGS. 11, 12 and 13 may also be applied to the production of a flanged shaft 1 having shaft end portions 2 of an equal length as shown in FIG. 1. The method shown in FIGS. 11 to 13, however, provide specific advantage when used in the production of a flanged shaft 1A having shaft end portions 2*a*, 2*b* of different lengths.

The methods described hereinbefore can be carried out without substantial difficulty when the blank can be plastically deformed by comparatively small compression force, e.g. aluminum. However, when a steel is used as the blank, certain problems occurs in regard to the strength of the die apparatus and the capacity of the press, because such a material requires a large compression force. In such a case, it is advisable to preheat the blank before the blank is placed in the die cavity, in order to reduce the deformation resistance. For instance, a 0.45% C steel (JIS S45C) exhibits, when heated up to 800° to 900° C., deformation resistance substantially equivalent to that exhibited by aluminum at 20° C.

As has been described, the present invention provides a forging method for producing a flanged shaft provided at its intermediate portion with a flange, the method comprising preparing a closed die apparatus defining a die cavity of a configuration substantially conforming with the shaft portions and the flange of the flanged shaft to be produced, placing a blank in the die cavity, the blank having a diameter smaller than that of the shaft portion of the flanged shaft but large enough to prevent buckling of the blank when the latter is compressed axially, and compressing the blank axially thereby to produce the flanged shaft. As will be fully realized from the foregoing description, this forging method of the invention offers various advantages such as high yield from material, elimination of necessity for large-size press, high dimensional precision and reduced number of finishing steps.

It is possible to apply the method of the invention to the production of a crank shaft, while fully enjoying various advantages.

It is possible to produce a crankshaft in accordance with the forging method of the invention. More particularly, as shown in FIG. 14 crankshaft generally designated by the reference numeral 10 has pin portions 10*a* and rod portions 10*b*, and an eccentric arm portion 10*c*.

Figure 14:
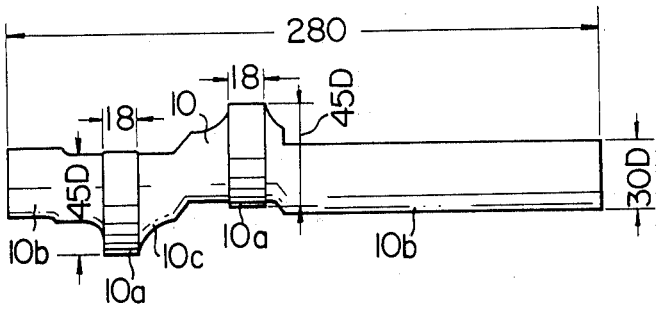
FIG. 14 is a side elevational view of a crank shaft.
Figure 15:
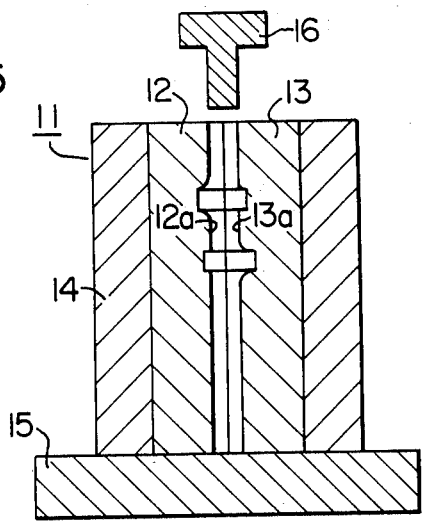
FIG. 15 is a sectional view of a closed die apparatus for use in a forging method of an embodiment of the invention for producing a crankshaft.

As shown in FIG. 15, a closed die apparatus 11 has a die assembly consisting of two die parts 12 and 13 having respective recesses 12*a* and 13*a* which are adapted to form, when brought together, a die cavity of a configuration having portions corresponding to the pin portions 10*a* and rod portions 10*b* of the crankshaft (FIG. 14). The die parts 12 and 13, in the coupled state, are adapted to be received and fixed by a shrink ring 14 which, in turn, is mounted on a base plate 15. An upper punch 16 attached to a press head (now shown) of the press is adapted to be driven slidingly into the die cavity formed by the recesses 12*a* and 13*a*.

Figure 16:
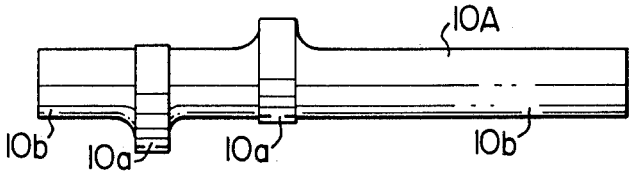
FIG. 16 is a side elevational view of a preforged blank having a pin portion preforged by means of the closed die apparatus shown in FIG. 15.
Figure 17:
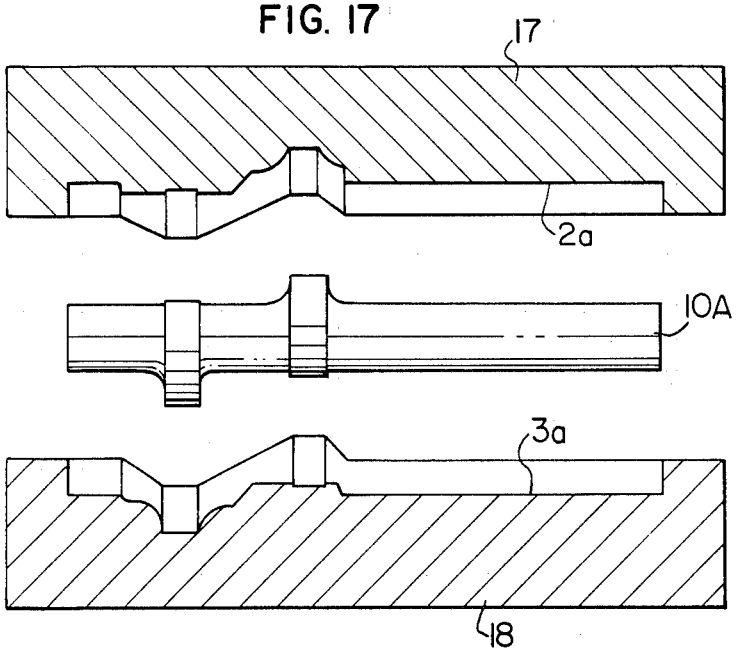
FIG. 17 is a side elevational view of an upper die and a lower die which are used in the second step of forging method for producing a crankshaft, showing also a preforged crankshaft in side elevation.

In the production of the crankshaft 10, a blank is prepared to have a diameter smaller than that of the rod portion of the crankshaft 10 but large enough to prevent buckling of the blank when the latter is compressed in the axial direction. In the illustrated case, the rod portion of the crankshaft 10 has a diameter of 30 mm and the diameter and length of the blank are selected to be 29.5 mm and 340 mm, respectively. The blank is inserted in the die cavity and the press head (not shown) is lowered to compress the blank axially from the upper side, so that the blank is plastically deformed to cause a plastic flow of the blank into the die cavity formed by the recesses 12*a* and 13*a* of the die parts 12 and 13 to complete the production of the pin portions (first step). Then, the die parts 12 and 13 are withdrawn from the shrink ring 14 and are separated from each other to permit a half-finished blank 10A shown in FIG. 16 to be easily removed. Then, the half-finished blank 10A is placed between an upper die 17 and a lower die 18 shown in FIG. 17 having recesses 17*a* and 18*a* which in combination define a die cavity substantially conforming with the final configuration of the crank shaft 10, and is compressed by the press head (now shown) in the direction perpendicular to the axis thereof, i.e. from the upper side as viewed in FIG. 17 (second step).

In this second step, since the pin portions 10*a* have been already produced, only the region around the eccentric portion 10*c* (see FIG. 14) are produced so that the generation of flashes is largely suppressed and the yield from the material is remarkably increased. Furthermore, the force required for the press work is reduced to less than a half of the required by the conventional method, because the area of contact between the half-finished blank 10A (FIG. 17) makes contact with the upper and lower die parts 17, 18 is reduced considerably.

In the first preforming step, the pin portions 10*a* are forged at a high precision due to the use of the closed die apparatus 11, while the second step for forging the eccentric portion of the crankshaft can be made with reduced generation of flashes. Consequently, the crankshaft 10 can be produced at a high dimensional precision throughout the process including the first and second steps. This remarkably reduces the amount of material to be removed in the finishing and, hence, the time and labor required for finishing by trimming (removal of flashes), cutting and grinding.

As explained before, in the conventional method using a blank of a large diameter, many flashes are generated in the rod portions and other portions and the flow-line is undesirably cut when the flashes are shown in the trimming step which is taken subsequently to the press work. The cutting of the flow-line unfavorably reduces the mechanical strength of the crankshaft as the product. Unlike the conventional method, however, the method of the invention does not cause cutting of the flow-line because almost no flash is generated around the rod portions so that the crankshaft can be produced to have a superior mechanical strength.

Although the first step in this method is conducted by the forging method explained before in connection with FIG. 2, this is not exclusive and the first step of this method can be effected by any one of the forging methods which have been explained with reference to FIGS. 6, 11, 12 and 13. Whichever one of these peforming forging method may be taken, the second step of pressing the half-finished blank into the final product is conducted by the die assembly consisting of the upper die part 17 and lower die part shown in FIG. 17.

As has been described, according to the invention, there is provided a forging method for producing a crankshaft by forging comprising the steps of: preparing a closed die means defining therein a die cavity of a configuration substantially conforming with that of the rod and pin portions of the crankshaft; inserting a blank into the closed die means, the blank having a diameter smaller than the diameter of the rod portion but large enough to avoid buckling of the blank when the latter is compressed in the axial direction; compressing the blank in the axial direction to preform the pin portion; inserting the preformed article into an openable die means consisting of an upper die and a lower die which cooperate, when brought together, with each other in defining therebetween a die cavity of a configuration substantially conforming with the final configuration of the crankshaft; and compressing the preformd article in the direction perpendicular to the axis thereby to form the crankshaft. As will be fully realized from the foregoing description, this method offers various advantages such as high yield from the material, elimination of necessity for large-size press and high dimensional precision which in turn reduces the time and labour required for the finishing work.

In some cases, the crankshaft has two shaft end portions, i.e. rod portions, of a large difference in length, and one of the rod portions has an extremely large value of the length-to-diameter ratio. A typical example of such crankshafts is a crankshaft of a compressor.

Figure 18:
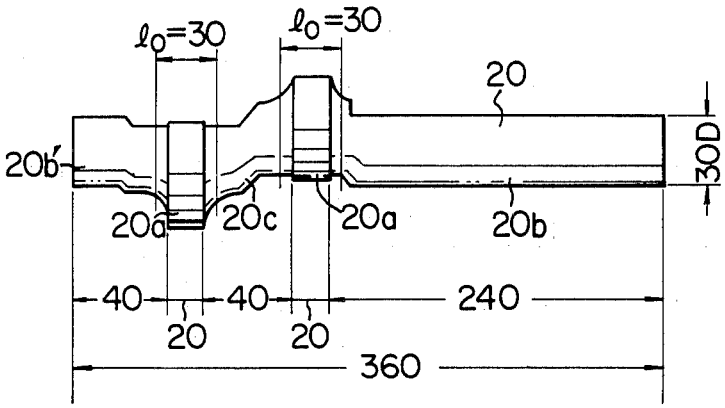
FIG. 18 is a side elevational view of an example of a crankshaft provided with a rod portion having a large value of length-to-diameter ratio l/d.
Figure 19:
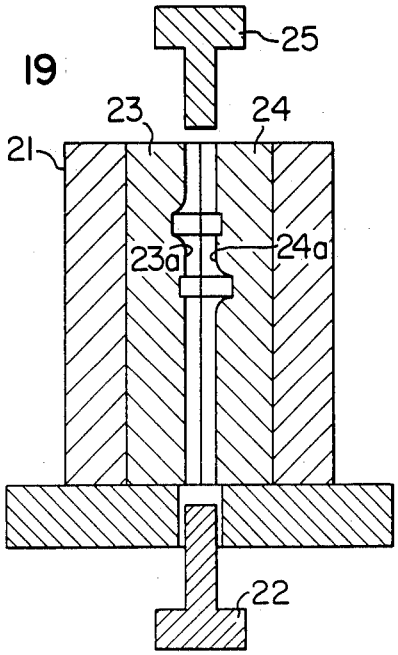
FIG. 19 is a sectional view of a closed die apparatus used in the first step of a forging method for producing a crankshaft.

As shown in FIG. 18, a crankshaft generally designated by the reference numeral 20 of a compressor have a rod portion of large length-to-diameter ratio. More particularly, the rod portion 20*b* has a length l of 240 mm and a diameter d of 30 mm and, hence, the length-to-diameter ratio of this rod portion is as large as $l/d=240/30=8$. Such a long rod portion is intended for fitting in a rotor core of a motor for driving the compressor. When the pin portions 20*a* of the crankshaft 20 are preformed by a closed die apparatus 21 shown in FIG. 19 in the described manner, the punch pressure (pressure and hence force applied to the punch when the blank is compressed) acting on the punch adjacent to the long rod portion 20*b*, i.e. the lower punch 22, is increased impractically to cause a possible failure of the lower punch 22. The amount of plastic deformation caused by the punch is increased as the length-to-diameter ratio l/d is increased to correspondingly increase the friction resistance acting between the blank and the die wall to further increase the punch pressure undesirably. To obviate this problem, it is conceivable to effect the forging in the hot state by heating the blank. The hot forging, however, deteriorates the lubricating condition although it is effective in reducing the deformation resistance, so that the punch pressure still remains high in spite of the reduced deformation resistance. On the contrary, the fear of failure of the punch is increased because the strength of the punch is decreased as a result of the contact with the hot blank.

Before turning to the detailed description of the method for forming the crankshaft 20, a theoretical approach will be made hereinunder to this method with specific reference to FIGS. 18 and 20.

Figure 20:
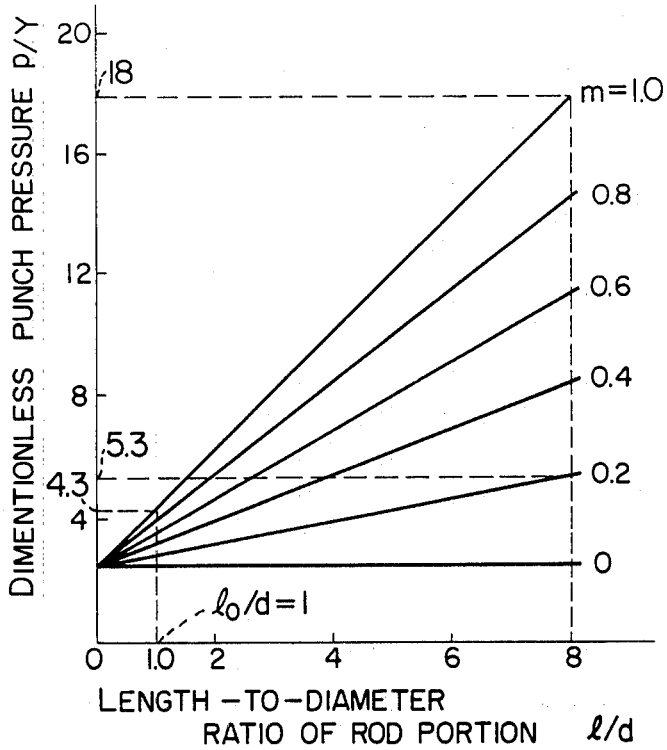
FIG. 20 is a diagram showing the relationship between the length-to-diameter ratio of rod portion l/d and dimensionless punch pressure p/Y in the preforging of a crankshaft.

FIG. 20 illustrates the relationship between the length-to-diameter ratio l/d and dimensionless punch pressure p/Y as obtained through calculations with the rod portion of the crankshaft 20, with a parameter m representing the friction factor. More specifically, in FIG. 20, the abscissa represents the length-to-diameter ratio l/d of the rod portion while the ordinate represents the dimensionless punch pressure p/Y in which p represents the punch pressure while Y represents the deformation resistance as obtained through a compression test of the blank material. The parameter m takes the minimum value 0 (zero) when there is no friction between the blank and the die wall and the maximum value 1 (one) when the blank sticks to the die wall.

As apparent from FIG. 20, if the blank is heated only locally at the regions which will constitute the pin portions and therearound (practical example of heating region will be shown later) before put into the die apparatus, the deformation of the blank in the preforming takes place only in the limited region around the pin portions and the contact between other portions of the blank with the die wall is avoided to reduce the friction and, hence, the punch pressure.

The preheating of the blank may, for example be carried out in the following manner. Assuming a blank made of 0.45%C steel which exhibits deformation resistances of 70 to 80 Kgf/mm$^2$ and 10 Kgf/mm$^2$ at room temperature and at 800° C., respectively. The blank is preheated to 800° C. only at the regions which will constitute the pin portions in the final product over lengths $l_0$ of 30 mm which provides the length-to-diameter ratio of one, while the other portions are held at temperature substantially equal to the room temperature. This heating state can easily be realized by a local heating by means of high-frequency induction heating or by a local quenching by water cooling or the like after heating of the whole portion of the blank by an oven or the like. As a result of this local heating of the blank, the plastic deformation during the preforming takes place only in the regions of $l_0/d=1$ including the pin portions. Even when the friction factor m takes the maximum value "1" in this state, the dimensionless punch pressure p/Y is 4.3 as shown in FIG. 20. Namely, the punch pressure p is given as $p=4.3\times 10$ Kgf/mm$^2$=43 Kgf/mm$^2$. In this state, the punch is held at a temperature substantially equal to the room temperature at which it exhibits a maximum allowable pressure of about 150 Kgf/mm$^2$ which is much higher than the above-mentioned value of the punch pressure. Namely, there is no fear of failure of the punch due to excessive punch pressure. In addition, the non-heated regions of the rod portion, which are maintained substantially at the room temperature, are not plastically deformed substantially even by the application of the punch pressure of 43 Kgf/mm$^2$, so that almost no contact takes place between these regions of rod portion and the die wall. Therefore, the preforming of the pin portions can be effected in a good manner even with the rod portion longer than that described.

In contrast, when the preforming is conducted at the room temperature at which the blank 0.45%C steel exhibits a high deformation resistance of 70 to 80 Kgf/mm$^2$, the dimensionless punch pressure p/Y acting on the rod portion having the length-to-diameter ratio l/d of 240/30=8 is as high as 5.3 even when the friction factor m takes a comparatively small value of 0.2. In this case, the punch pressure p is as high as 370 to 420 Kgf/mm$^2$ which is much higher than the maximum allowable value. In this case, therefore, the punch is failed undesirably.

Assuming that the preforming is conducted by a hot work, the lubricating condition is deteriorated to increase the friction factor, although the deformation resistance can be decreased to a level less than 10 Kgf/mm$^2$. In the worst case, the friction factor m is increased to the maximum value "1". In such a case, the rod portion having the ratio l/d of eight requires a dimensionless punch pressure of eighteen, i.e. a punch pressure of 180 Kgf/mm$^2$. Considering that the strength of the punch itself is decreased as a result of the heating by the heat derived from the hot blank, the above-mentioned punch pressure of 180 Kgf/mm$^2$ is unacceptably large. In addition, the punch pressure is further increased as the ratio l/d is increased. For these reasons, the preforming of the crankshaft by the method illustrated in FIG. 19 cannot be carried out successfully by a mere hot forging.

As has been described, according to the invention, it is possible to preform the crankshaft having a rod portion of a large length-to-ratio, without causing failure of the punch, due to the local heating of the blank only at regions thereof corresponding to the pins and therearound.

With this knowledge, an explanation will be given hereinunder as to the forging method for producing a crankshaft 20 shown in FIG. 18.

A blank is prepared from 0.45%C steel material (deformation resistance Y=70 to 80 Kgf/mm$^2$ at room temperature) to have a diameter smaller than the diameter of the rod portions **20*b*, 20*b*' of the final product but large enough to prevent buckling of the material when the latter is compressed axially. In the illustrated embodiment, the rod portions 20*b*, 20*b*'** have a diameter of 30 mm, a diameter of the blank is selected to be 29.5 mm, and the length of the blank is 420 mm.

Then, the blank is locally heated up to about 800° C. only at regions thereof which will constitute the pin portions **20*a* of the crankshaft and around these regions over lengths of $l_0/d=1$ i.e. over the lengths $l_0$ of 30 mm. The local heating is conducted by means of, for example, high-frequency induction heating. The locally heated blank is then placed in the die cavity formed by the recesses 23*a*, 24*a* of the die parts 23, 24 of the die assembly 21 contacted together, such that the preheated regions are aligned with the die cavity portions corresponding to the pins of the crankshaft, and preforming pressure is applied form the upper side and lower side by the upper punch 25 and the lower punch 22. The die cavity portion corresponding to the upper pin is filled by the plastic flow of the material caused by the compression exerted by the upper punch 25, while the die cavity portion corresponding to the lower pin is filled by the plastic flow of the material caused by the pressure applied by the lower punch. The compression exerted by both punches 25 and 22** may be applied simultaneously or, alternatively, at a staggered manner as explained before.

By effecting the preforming after locally heating the blank, the plastic deformation is allowed to occur only in the restricted regions of lengths $l_0/d=1$ around the pins **20*a*. Consequently, as will be understood from FIG. 20**, it is possible to maintain the dimensionless punch pressure p/Y at a low level of 4.3 even if the friction factor m takes the maximum value of 1.0 and, hence, the punch pressure as low as 43 Kgf/mm$^2$ because the deformation resistance is 10 Kgf/mm$^2$. This punch pressure is much lower than the aforementioned maximum allowable pressure which is about 150 Kgf/mm$^2$. The non-heated regions of the rod is held at a low temperature substantially equal to the room temperature so that no substantial plastic deformation takes place in such regions even by the application of the punch pressure of 43 Kgf/mm$^2$, so that these regions do not impose substantial frictional resistance.

As will be understood from the foregoing description, forging method for producing a crankshaft comprises the steps of: preparing a closed die means defining therein a die cavity of a configuration substantially conforming with that of the rod and pin portions of the crankshaft; preparing a blank having a diameter smaller than the diameter of the rod portion but large enough to avoid buckling of the blank when the latter is compressed in the axial direction; preheating the blank only at region thereof which will become the pin portion, as well as portions around the region; inserting the preheated blank into the closed die means; compressing the blank in the axial direction to preform said pin portion; inserting the preformed article into an openable die means consisting of an upper die and a lower die which when brought together, cooperate with each other in defining therebetween a die cavity of a configuration substantially conforming with the final configuration of the crankshaft; and compressing the preformed article in the direction perpendicular to the axis thereby to form the crankshaft. According to this forging method, it is possible to preform the crankshaft without troubles such as failure of the punch, even when the crankshaft has a rod portion of a large value of the length-to-diameter ratio.

What is claimed is:

1. A forging method for producing a flanged shaft provided at an intermediate portion thereof with two flanges, the method comprising the steps of: preparing a closed die means defining therein a die cavity of a configuration substantially conforming with the flanges and shaft of said flanged shaft;

inserting a blank into said closed die means, said blank having a diameter smaller than a diameter of the shaft but large enough to avoid buckling when compressed in an axial direction;

compressing said blank in an axial direction to thereby produce the flanged shaft;

said blank is axially compressed at two axial ends thereof without removal from said closed die means to produce a flanged shaft having two flanges; and wherein a period of application of compression to one axial end of said blank to form a first flange and a period of application of compression to the other axial end of said blank to form the second flange are staggered from each other.

2. A forging method according to claim 1, wherein said blank is locally preheated only in regions thereof at which the flanges are located prior to insertion into said closed die means.

3. A forging method for producing a flanged shaft provided at an intermediate portion thereof with two flanges, the method comprising the steps of: preparing a closed die means defining therein a die cavity of a configuration substantially conforming with the flanges and shaft of said flanged shaft;

inserting a blank into said closed die means, said blank having a diameter smaller than the diameter of the shaft but large enough to avoid buckling when compressed in an axial direction;

compressing said blank in an axial direction to thereby produce said flanged shaft, and wherein the axial compression of said blank is made only from the upper side of said blank to produce a first flange and, after suspending an application of compression, said die means holding the half-finished blank therein is turned upside down and, subsequently, the compression is applied to said blank again to produce a second flange to thereby produce a flanged shaft having two flanges.

4. A forging method for producing a crankshaft provided at an intermediate portion thereof with two pins, the method comprising the steps of: preparing a closed die means defining therein a die cavity of a configuration substantially conforming with that of a rod and the pins of said crankshaft; inserting a blank into said closed die means, said blank having a diameter smaller than a diameter of said rod but large enough to avoid buckling of said blank when the latter is compressed in an axial direction; compressing said blank in the axial direction to preform said pins; inserting the preformed blank into an openable die means consisting of an upper die and a lower die which, when brought together, cooperate with each other in defining therebetween a die cavity of a configuration substantially conforming with a final configuration of said crankshaft; and compressing the preformed blank in a direction perpendicular to the axis to thereby produce said crankshaft; wherein, said blank is axially compressed during preforming at both axial ends thereof without removal from said die cavity to produce a crankshaft having two pins, and wherein, during preforming, a period of application of compression to one axial end of said blank to preform a first pin and a period of application of compression to the other axial end of said blank to preform the second pin are staggered to produce a crankshaft having the two pins.

5. A forging method according to claim 4, wherein said blank is heated locally only at a region thereof at which said pins are located and a region around said pins before the blank is placed into said die means for preforming.

6. A forging method for producing a crankshaft provided at an intermediate portion thereof with two pins, the method comprising the steps of: preparing a closed die means defining therein a die cavity of a configuration substantially conforming with a rod and the pins of said crankshaft; inserting a blank into said closed die means, said blank having a diameter smaller than a diameter of said rod but large enough to avoid buckling of said blank when the latter is compressed in an axial direction; compressing said blank in the axial direction to preform said pins; inserting the preformed blank into an openable die means consisting of an upper die and a lower die which, when brought together, cooperate with each other in defining therebetween a die cavity of a configuration substantially conforming with a final configuration of said crankshaft; and compressing the preformed blank in a direction perpendicular to the axis to thereby produce said crankshaft; and wherein the axial compression of said blank is made only from the upper side of said blank to preform a first pin and, after suspending the application of compression, said die means holding the half-finished blank therein is turned upside down and, subsequently, the compression is again applied to said blank to preform a second pin to thereby produce a crankshaft having two pins.

* * * * *